US011350750B2

(12) United States Patent
Slongo et al.

(10) Patent No.: US 11,350,750 B2
(45) Date of Patent: Jun. 7, 2022

(54) TILT MECHANISM FOR A CHAIR AND CHAIR

(71) Applicant: L&P PROPERTY MANAGEMENT COMPANY, South Gate, CA (US)

(72) Inventors: Alessandro Slongo, Mogliano Veneto TV (IT); Massimo Costaglia, Santa Giustina in Colle PD (IT); Nigel Charles Fitzsimmonds, Alnwick (GB)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 18 days.

(21) Appl. No.: 17/048,175

(22) PCT Filed: Apr. 4, 2019

(86) PCT No.: PCT/EP2019/058472
§ 371 (c)(1),
(2) Date: Oct. 16, 2020

(87) PCT Pub. No.: WO2019/201608
PCT Pub. Date: Oct. 24, 2019

(65) Prior Publication Data

US 2021/0368982 A1 Dec. 2, 2021

(30) Foreign Application Priority Data

Apr. 17, 2018 (EP) ..... 18167704

(51) Int. Cl.
*A47C 1/032* (2006.01)
*A47C 7/44* (2006.01)

(52) U.S. Cl.
CPC ..... *A47C 1/03272* (2013.01); *A47C 1/03205* (2013.01); *A47C 1/03255* (2013.01)

(58) Field of Classification Search
CPC ..... A47C 1/03272; A47C 1/03261; A47C 1/03205; A47C 1/03255
(Continued)

(56) References Cited

U.S. PATENT DOCUMENTS 4,685,733 A * 8/1987 Machate ..... A47C 7/46 297/300.6 X
4,773,706 A * 9/1988 Hinrichs ..... A47C 1/03255 297/300.5
(Continued)

FOREIGN PATENT DOCUMENTS

CN 201175121 Y * 1/2009 ..... A47C 1/032
CN 203378783 U 1/2014
(Continued)

OTHER PUBLICATIONS

Extended European Search Report and Opinion received for EP Patent Application No. 18167704.8, dated Jul. 18, 2018, 8 pages.
(Continued)

*Primary Examiner* — Rodney B White
(74) *Attorney, Agent, or Firm* — Shook Hardy & Bacon, LLP

(57) ABSTRACT

A tilt mechanism for a chair comprises a base, a first support configured to support a chair seat and mounted to the base, a second support configured to support a chair back and pivotably coupled to the base about the first pivot axis, a link element pivotably coupled to the second support about a second pivot axis, and a shaft attached to the first support. A first guide slot is provided at the base and a second guide slot is provided at the link element. The shaft is supported in the first guide slot and the second guide slot.

16 Claims, 15 Drawing Sheets

(58) Field of Classification Search
USPC ..... 297/285, 289, 300.5
See application file for complete search history.

(56) References Cited

U.S. PATENT DOCUMENTS

| | | | | | |
|---|---|---|---|---|---|
| 5,228,748 | A | | 7/1993 | Neumuller | |
| 5,251,958 | A | | 10/1993 | Roericht et al. | |
| 5,340,194 | A | | 8/1994 | Neumuller | |
| 5,348,371 | A | * | 9/1994 | Miotto | A47C 1/03294 297/303.2 |
| 5,397,165 | A | * | 3/1995 | Grin | A47C 1/03266 297/300.5 |
| 5,582,459 | A | * | 12/1996 | Hama | A47C 1/03294 297/285 X |
| 6,131,998 | A | * | 10/2000 | Su | A47C 1/03255 297/300.5 X |
| 6,945,602 | B2 | | 9/2005 | Fookes et al. | |
| 7,614,697 | B1 | | 11/2009 | Lai | |
| 7,887,132 | B2 | | 2/2011 | Link | |
| 8,613,482 | B2 | | 12/2013 | Ni | |
| 10,143,306 | B2 | | 12/2018 | Bock | |
| 2003/0132653 | A1 | | 7/2003 | Thole | |
| 2010/0164263 | A1 | * | 7/2010 | Malenotti | A47C 1/03255 297/300.1 |
| 2013/0320732 | A1 | | 12/2013 | Bock | |
| 2014/0028068 | A1 | * | 1/2014 | Birkbeck | A47C 1/03272 297/340 |
| 2014/0300158 | A1 | * | 10/2014 | Jones | A47C 1/03272 297/303.1 |
| 2015/0282620 | A1 | | 10/2015 | Bock | |
| 2016/0174720 | A1 | | 6/2016 | Sander et al. | |
| 2020/0268155 | A1 | * | 8/2020 | Brais | A47C 1/03277 |

FOREIGN PATENT DOCUMENTS

| | | | | | |
|---|---|---|---|---|---|
| EP | 1258212 | A2 | * | 11/2002 | A47C 1/03272 |
| EP | 0 954 997 | B1 | | 7/2004 | |
| EP | 1 256 294 | B1 | | 9/2004 | |
| EP | 1 033 927 | B1 | | 6/2005 | |
| EP | 1 906 792 | B1 | | 2/2010 | |
| EP | 1 865 810 | B1 | | 3/2011 | |
| EP | 2 389 840 | A1 | | 11/2011 | |
| EP | 1 563 766 | B1 | | 2/2012 | |
| EP | 1 989 961 | B1 | | 8/2012 | |
| EP | 2 375 938 | B1 | | 9/2012 | |
| EP | 2 477 523 | B1 | | 6/2013 | |
| EP | 2 608 700 | A1 | | 7/2013 | |
| EP | 2 538 820 | B1 | | 1/2014 | |
| EP | 2 409 602 | B1 | | 6/2014 | |
| EP | 2 772 156 | A1 | | 9/2014 | |
| EP | 2772156 | A1 | * | 9/2014 | A47C 1/03272 |
| EP | 2 670 279 | B1 | | 5/2016 | |
| EP | 2 339 943 | B1 | | 6/2016 | |
| EP | 2 886 015 | B1 | | 7/2016 | |
| EP | 3 120 732 | A1 | | 1/2017 | |
| WO | 86/02536 | A1 | | 5/1986 | |
| WO | 2007/012418 | A1 | | 2/2007 | |
| WO | 2008/149224 | A1 | | 12/2008 | |
| WO | 2010/103554 | A1 | | 9/2010 | |
| WO | 2011/032689 | A1 | | 3/2011 | |
| WO | 2012/025134 | A1 | | 3/2012 | |
| WO | 2012/041448 | A1 | | 4/2012 | |
| WO | 2013/011052 | A1 | | 1/2013 | |
| WO | 2015/072398 | A1 | | 5/2015 | |
| WO | 2015/145216 | A1 | | 10/2015 | |
| WO | 2016/124317 | A1 | | 8/2016 | |

OTHER PUBLICATIONS

Office Action received for EP Patent Application No. 18167704.8, dated Nov. 27, 2018, 4 pages.

International Search Report and Written Opinion received for PCT Patent Application No. PCT/EP2019/058472, dated Apr. 23, 2019, 10 pages.

Intention to grant received for EP Patent Application No. 18167704.8, dated Dec. 11, 2019, 43 pages.

Decision to grant received for EP Patent Application No. 18167704.8, dated Apr. 17, 2020, 2 pages.

* cited by examiner

TILT MECHANISM FOR A CHAIR AND CHAIR

CROSS-REFERENCE TO RELATED APPLICATIONS

This application claims priority under 35 U.S.C. § 365 to PCT/EP2019/058472, filed on Apr. 4, 2019, entitled "Tilt Mechanism for a Chair and Chair," and European Patent Application No. EP18167704.8, filed Apr. 17, 2018, entitled "Tilt Mechanism for a Chair and Chair," the entirety of the aforementioned applications are incorporated by reference herein.

FIELD OF THE INVENTION

The present invention relates to a tilt mechanism for a chair. In particular, the present invention relates to a tilt mechanism for a chair having a chair seat and a chair back, wherein the tilt mechanism allows the chair seat to be displaced and the chair back to be inclined in a coordinated manner. The present invention relates furthermore to a chair comprising the tilt mechanism.

BACKGROUND OF THE INVENTION

Common adjustments for chairs, in particular office-type chairs, include a height adjustment of the chair seat, an adjustment of an inclination of the chair seat and the chair back as well as an arrangement of the chair seat with respect to the chair back. These chair adjustments allow users to change their sitting position in the chair as desired, such that fatigue may be minimised during long sitting periods.

Chair configurations may implement a feature which allows a chair back and a chair seat to move simultaneously during a tilting or rearwardly inclining motion of the chair back. The chair seat may also tilt in this motion or may be displaced otherwise relative to the chair base or chair back. The combined movement of the chair back and the chair seat may simplify chair adjustment.

Different types of chairs may impose different constraints on the adjustment mechanism. For example, the chair tilt mechanism should be able to move between a zero tilt and a full tilt position, while not moving the occupant's centre of gravity relative to a chair base assembly so much that an overbalancing or tipping occurs. The shift in centre of gravity which is acceptable depends on the configuration of the chair base assembly. It may be desirable to implement a chair tilt mechanism which can be easily adapted to different chair requirements.

BRIEF SUMMARY OF THE INVENTION

There is a need in the art for a chair tilt mechanism and a chair which address some of the above needs. In particular, there is a need in the art for a chair tilt mechanism which is a simple and reliable construction and which provides easy adaption to different chair requirements.

According to an embodiment, a tilt mechanism for a chair is provided. The tilt mechanism is configured to affect a coordinated movement of a chair seat and a chair back. The tilt mechanism comprises a base, a first support, a second support, and a link element. The first support is configured to support the chair seat and is mounted to the base. The first support may be indirectly mounted to the base, in particular via the link element. Furthermore, the first support may be connected to the base. For example, the first support may be mounted such to the base that it may be displaceable in a forward and backward manner as well as being tilted. The second support is configured to support the chair back and is pivotably coupled to the base about a first pivot axis. The link element is pivotably coupled to the second support such that it is pivotable about a second pivot axis. A shaft of the tilt mechanism is attached to the first support. A first guide slot is provided at the base and a second guide slot is provided at the link element. The shaft can slide whilst being supported in the first guide slot and the second guide slot such that pivoting the second support relative to the base causes the shaft to be displaced along the first guide slot and the second guide slot.

The tilt mechanism may comprise a further shaft attached to the first support which can slide whilst being supported in a third guide slot at the base.

The longitudinal direction of the further shaft may be parallel to a longitudinal direction of the shaft.

In this tilt mechanism, a movement of the first support supporting the chair seat is coupled via the link element with a movement of the second support supporting the chair back. In other words, the link element is an independent element which is not part of the first support, the second support or the base. In particular, the link element is rotatable with respect to the second support via the second pivot axis, and the link element is rotatable and displaceable in the front-rear and up-down directions with respect to the first support and the base. Due to the link element, the trajectory of the movement of the first support may be designed independently from a trajectory of the second support. The trajectory of the first support may include displacing and tilting the first support. The trajectory of the first support may be defined by the first guide slot and the third guide slot in the base. This provides a certain degree of flexibility in defining the trajectory of the first support and thus the chair seat, while providing a simple construction of the coupling between the chair back and the chair seat. The characteristics of the displacement and tilt may be altered by appropriately selecting for example a slope of the first guide slot and the third guide slot during manufacture. In particular, the first and third guide slots may be directed upwardly when the chair back is inclined rearwardly such that the tilt mechanism provides self-weighing characteristics.

A longitudinal direction of the shaft may be parallel to the first pivot axis.

The second pivot axis may be different from the first pivot axis.

The first pivot axis may be parallel to the second pivot axis.

The first guide slot may comprise a first linear guide slot and the second guide slot may comprise a second linear guide slot.

Furthermore, the first linear guide slot and the second linear guide slot may be arranged nonparallel such that, when the shaft is displaced along the first and second linear guide slots, an angle between a direction of the first linear guide slot and a direction of the second linear guide slot varies. In other words, when the first and second linear guide slots are arranged nonparallel, an unambiguous and therefore coordinated arrangement of the shaft with respect to the base depending on the inclination of the chair back can be achieved, which provides, due to the coupling of the shaft to the chair seat, an unambiguous and coordinated arrangement of the chair seat.

The tilt mechanism may furthermore comprise an energy storage mechanism, for example a spring, including a first end and second end. The first end may be coupled to a first attachment structure provided at the link element and the second and may be coupled to a second attachment structure provided at the base. An energy level stored in the energy storage mechanism may depend on a distance between the first end and the second end.

The tilt mechanism may be configured such that the distance between the first attachment structure and the second attachment structure varies upon pivoting the second support relative to the base.

The first attachment structure may be provided at the second pivot axis.

The energy storage mechanism may comprise a single tension spring.

The energy storage mechanism as defined and arranged as described above, may provide self-weighing characteristics when using the tilt mechanism by a user sitting on the chair seat.

The second support supporting the chair back may comprise a U-shaped section forming a central section, a first arm and second arm. The central section may be coupled to the chair back. The first and second arm may extend from the central section in an essentially perpendicular direction. A pin may extend along the second pivot axis from the first arm to the second arm through an opening in the link element. For example, the first and second arm may extend in an essentially parallel manner with the link element arranged between the first and second arms. The pin may include a first end and a second end in its longitudinal direction. The first attachment structure may be arranged closer to the first end of the pin than to the second end of the pin. In other words, the energy storage mechanism is not coupled centric at the link element. Rather, the energy storage mechanism is coupled to the link element closer to the first end of the pin.

The tilt mechanism may comprise a locking mechanism mounted at the base and configured to engage with a locking section provided at the link element for inhibiting a movement, e.g. a rotation of the link element upon actuating the locking mechanism.

The locking section may be arranged closer to the second end of the pin than to the first end of the pin.

By arranging the energy storage mechanism at one end of the pin and the locking mechanism at the other end of the pin, a compact arrangement may be achieved.

According to another embodiment, a chair is provided. The chair comprises a chair base assembly, a chair seat, a chair back, and a tilt mechanism. The tilt mechanism is configured to affect a coordinated movement of the chair seat and the chair back. The tilt mechanism comprises a base, a first support configured to support the chair seat and mounted to the base, a second support configured to support the chair back and pivotably coupled to the base about a first pivot axis, a link element pivotably coupled to the second support about a second pivot axis, and a shaft attached to the first support. The base of the tilt mechanism is attached to the chair base assembly, the chair seat is attached to the first support, and the chair back is attached to the second support. A first guide slot is provided at the base and a second guide slot is provided at the link element. The shaft can slide and is supported in the first guide slot and the second guide slot such that pivoting the second support relative to the base causes the shaft to be displaced along the first and second guide slots.

The tilt mechanism may be the tilt mechanism of any aspects or embodiments of the invention.

The tilt mechanism and the chair according to embodiments may be utilised for various applications in which a coordinated inclining motion of the chair back and a motion of the chair seat is desired. For example, the chair tilt mechanism may be utilised in an office chair.

BRIEF DESCRIPTION OF THE DRAWINGS

Embodiments of the invention will be described with reference to the accompanying drawings.

DETAILED DESCRIPTION OF EMBODIMENTS

Exemplary embodiments of the invention will be described with reference to the drawings. While some embodiments will be described in the context of specific fields of application, such as in the context of an office type chair, the embodiments are not limited to this field of application. The features of the various embodiments may be combined with each other unless specifically noted otherwise. Same reference signs in the various drawings refer to similar or identical components.

Figure 1:
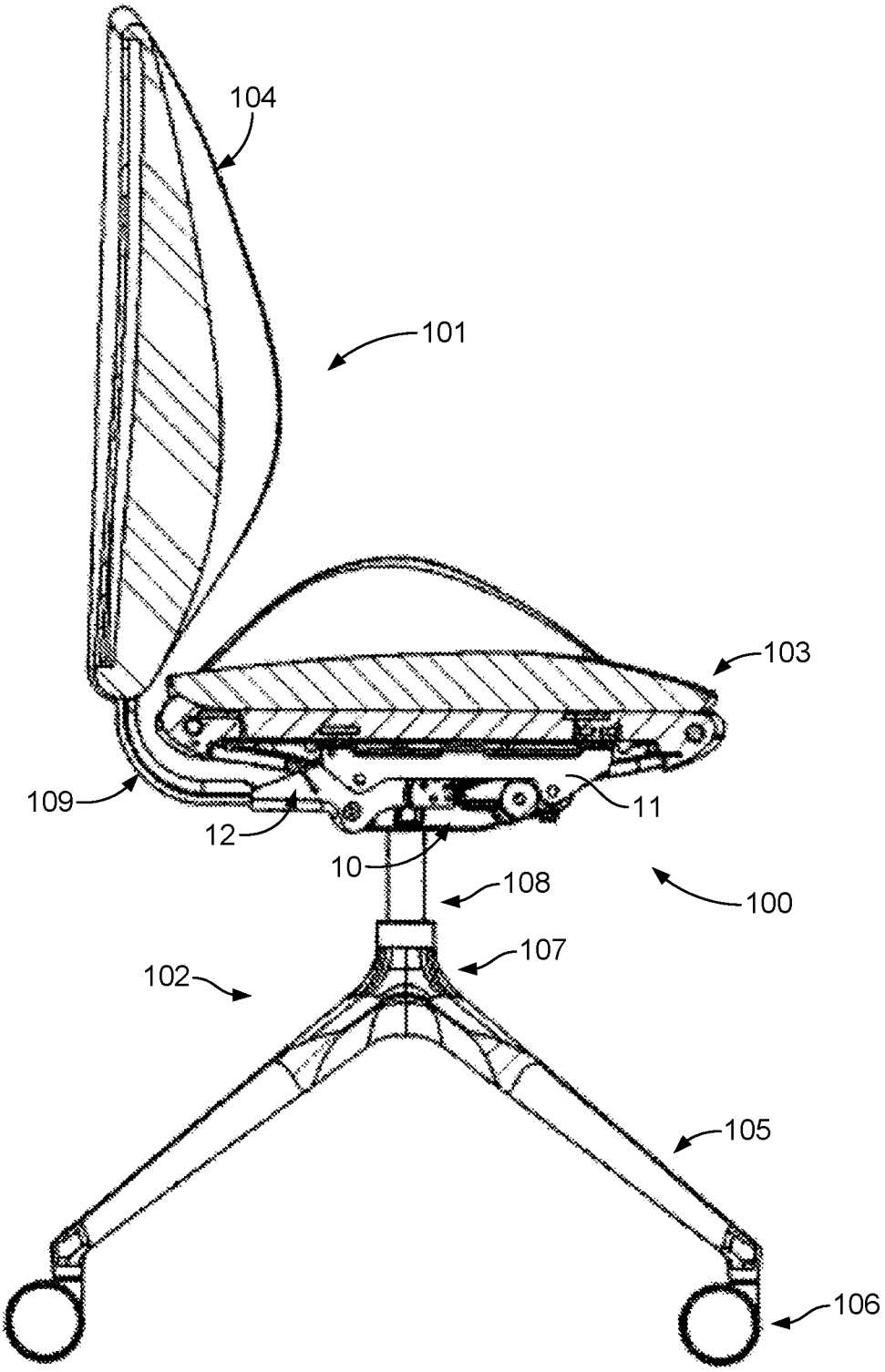
FIG. 1 is a schematic view of a chair having a chair tilt mechanism according to an embodiment.

FIG. 1 shows a chair 101 which includes a tilt mechanism 100 of an embodiment. The chair 101 is illustrated to be an office-type chair having a chair base assembly 102 and a superstructure. The superstructure includes a chair seat 103, a chair back 104 and components to interconnect the seat 103 with the back 104. The components which will be described in more detail below, include a tilt mechanism 100 for effecting a coordinated motion of the back 104 and the seat 103. The base assembly 102 includes a pedestal column 107, a number of support legs 105 extending radially from the column 107 and a corresponding number of casters 106 supported on the outer ends of the support legs 105. Additionally, a gas cylinder 108 or other lifting mechanism may be supported by the column 107 to enable the height of the seat 103, and thus of the chair superstructure, to be adjusted by an occupant.

It is to be understood that the terms "forward", "rearward" and "lateral", as used herein, each have a particular meaning that is defined in relation to a flat support surface beneath the chair 101 (for example parallel to a floor on which the casters 106 rest) and in relation to an occupant of the chair. For example, the term "forward" refers to a direction moving away from the back 104 and in front of a chair occupant along an axis which extends parallel to such a flat support surface, while the term "rearward" refers to a direction opposite to the forward direction. The term "lateral" refers to a generally horizontal direction perpendicular to both the forward and rearward direction and extending parallel to the aforementioned flat support surface. The tilt mechanism also defines a rearward direction, to which the second support extends, and an opposing forward direction. The attachment between a base of the tilt mechanism 100 and the chair base assembly 102 also defines which plane of the tilt mechanism will be oriented horizontally in the installed date of the tilt mechanism.

The chair 101 includes the tilt mechanism 100. Generally, the tilt mechanism 100 is operated to implement a coordinated motion of the seat 103 and the back 104 when the back 104 is tilted. The tilt mechanism 100 includes a base 10 which, in the installed state of the tilt mechanism 100 in which the tilt mechanism 100 is incorporated into the chair 101 as illustrated in FIG. 1, is coupled to the pedestal column 107 via the lifting mechanism 108. The tilt mechanism 100 includes a seat support 11 which, in the installed state of the tilt mechanism 100, is directly coupled to the seat 103 and supports the seat 103 at a lower side thereof. The seat support 11 acts as first support which is connected to the base 10. The seat support 11 may be mounted to the base 10 such that it is displaceable with respect to the base 10.

The seat 103 may be fixedly coupled to the seat support 11, such that a translational or rotational motion of the seat support 11 causes the seat 103 to move jointly with the seat support 11 in a translational or rotational manner. The tilt mechanism 100 includes a back support 12 which, in the installed state of the tilt mechanism 100, is coupled to the back 104. The back 104 may be attached to the back support 12 using suitable connecting members, such as a bar 109 fixed to the back support 12. The bar 109 may be directly and rigidly attached to the back support 12. The back support 12 acts as a second support.

As will be described in more detail with reference to FIGS. 2 to 15, the tilt mechanism 100 is configured such that the back support 12 is pivotably coupled to the base 10, allowing the back support 12 to pivot relatively to the base 10. The tilt mechanism 100 has a coupling mechanism coupling both the seat support 11 and the back support 12 to the base 10. The coupling mechanism includes a link element pivotably coupled to the back support 12, a first guide slot provided at the base 10, a second guide slot provided at the link element, and a shaft attached to the seat support 11 can slide whilst being supported in the first guide slot and the second guide slot.

When the back 104 is tilted, the link element is moved in the rearward direction which drives the shaft along the second guide slot via a shear action. As the shaft is supported by the first and second guide slots, the shaft simultaneously moves along the first guide slot thus driving the seat support 11. When the back 104 is tilted, the seat support 11 is thereby displaced relative to the base 10 and, thus, relative to the chair base assembly 102.

As used herein, the term "guide slot" refers to a slot which may be formed as a cut-out, which means a through slot, or as a blind slot. The guide slots described herein may be linear guide slots, which means that the slots are extending in an essentially straight manner. The linear guide slot has a linear centre axis extending linearly from one end of the slot to the opposite end of the slot along the slot longitudinal axis.

Figure 2:
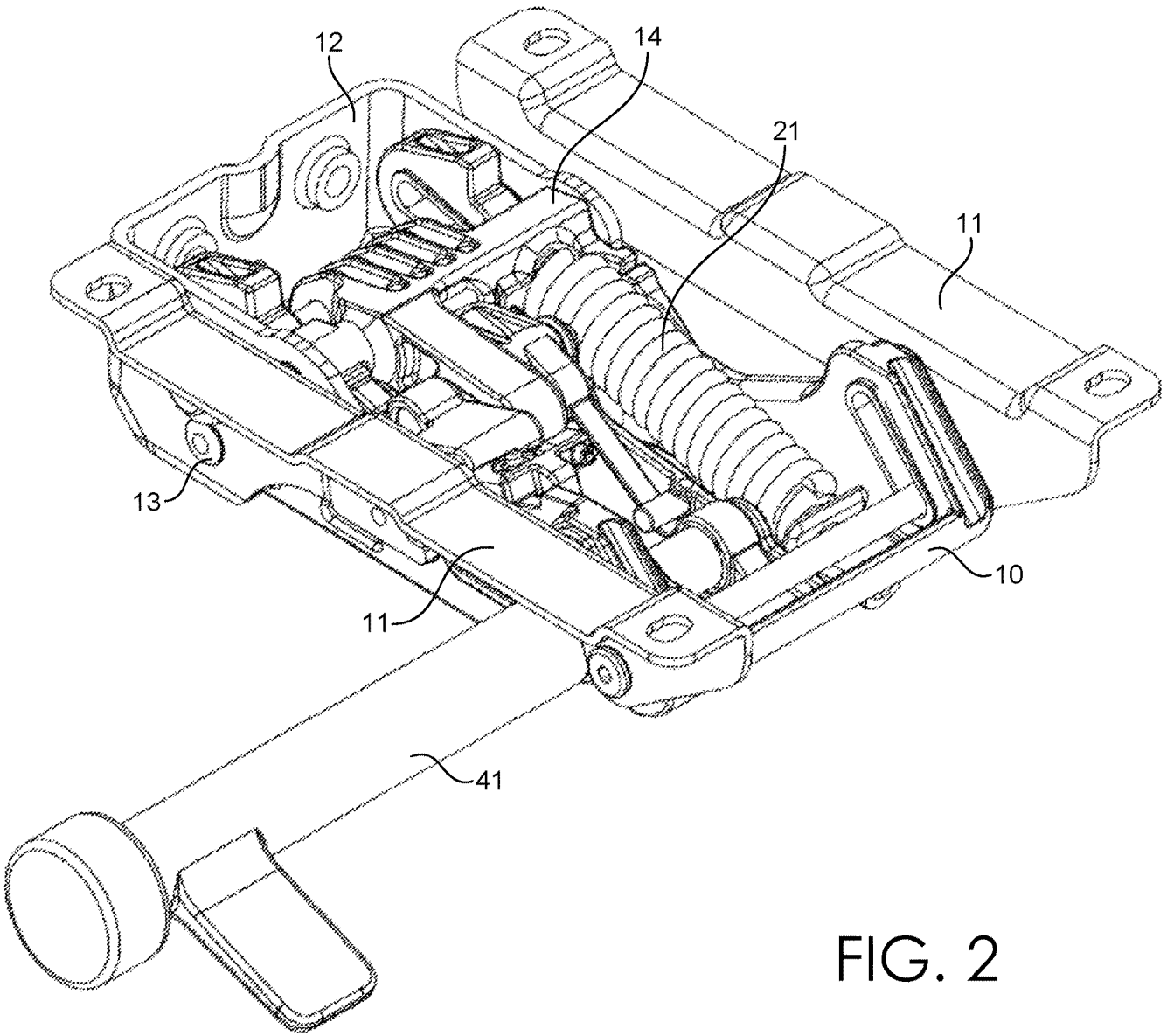
FIG. 2 is a schematic perspective view of a chair tilt mechanism according to an embodiment.
Figure 3:
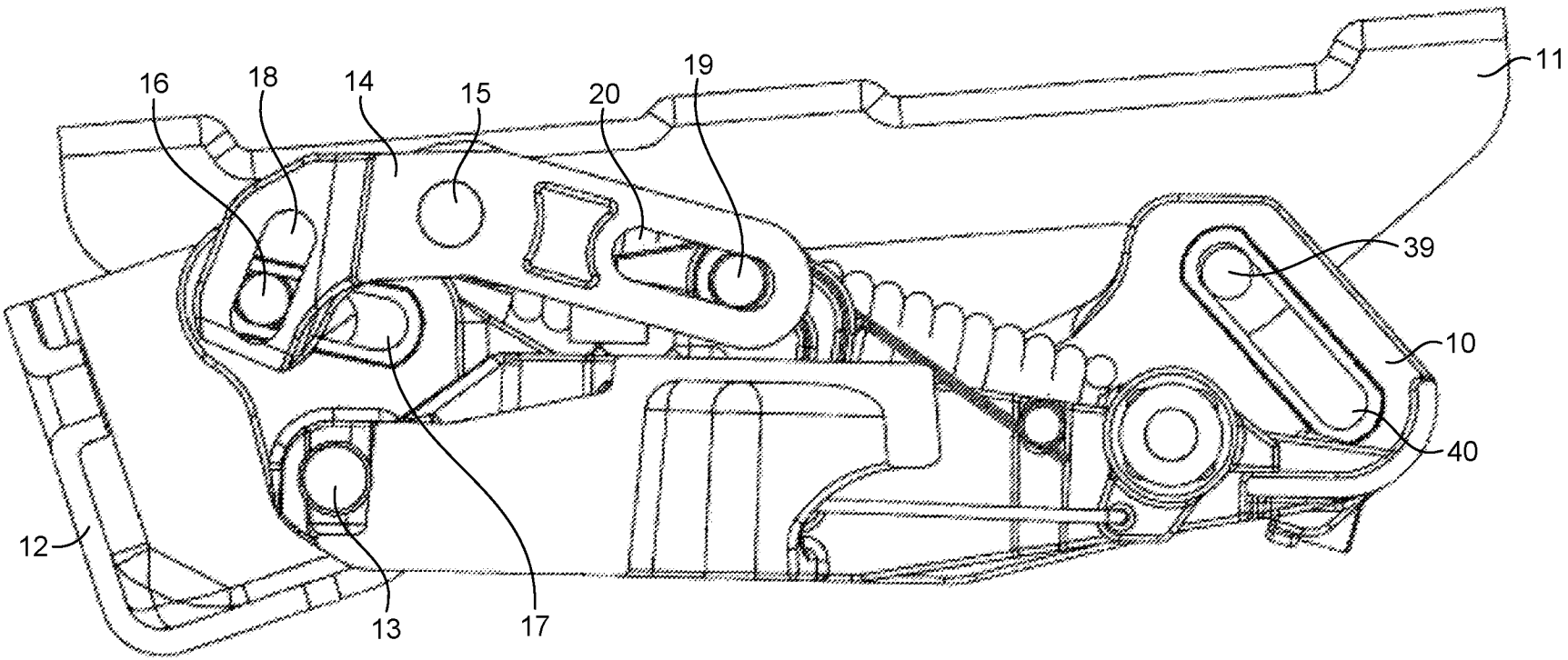
FIG. 3 is a schematic cross-sectional side view of the chair tilt mechanism of FIG. 2 in a full-tilted position.

FIGS. 2 and 3 show a perspective view and side view, respectively, of the tilt mechanism 100. The tilt mechanism 100 comprises a base 10, which may be coupled to the gas cylinder 108, a first support (seat support) 11 configured to support the chair seat 103 and connected to the base 10, a second support (back support) 12 configured to support the chair back 104 and pivotably coupled to the base 10 about a first pivot axis 13, a link element 14 pivotably coupled to the second support 12 about a second pivot axis 15, and a shaft 16 attached to the first support 11. A first guide slot 17 is provided at the base 10 and a second guide slot 18 is provided at the link element 14. The shaft 16 can slide whilst being supported in the first guide slot 17 and the second guide slot 18 such that pivoting the second support 12 relative to the base 10 causes the link element 14 to be moved in the rearward direction, which causes the shaft 16 to be displaced along the first guide slot 17 and the second guide slot 18.

The link element 14 may comprise an individual element which is not part of the first support 11, the second support 12 or the base 10. The link element 14 may be rotatable with respect to the second support 12 about the second pivot axis 15. Further, the link element 14 may be rotatable and displaceable in the front-rear and up-down directions with respect to the first support 11 and the base 10.

The tilt mechanism 100 may have a compact and simple construction, with the coupling between the first support 11 and the second support 12 implemented in a structure disposed below the chair seat. The tilt mechanism 100 may provide self-weighing characteristics.

The tilt mechanism 100 may include a biasing mechanism to bias the tilt mechanism 100 into a position in which the back 104 is in its foremost position. The biasing mechanism may be implemented by a spring 21, for example a tension spring or a compression spring.

The base 10 generally has a U-shaped cross section in a plane extending in the lateral direction of the tilt mechanism 100. The base 10 has a bottom wall, which may be coupled to the chair base assembly 102. From the bottom of the base 10 to side walls may extend in an upward and forward-backward direction of the tilt mechanism 100. Within this U-shaped cross section of the base 10, the link element 14 and the spring 21 as well as further components for controlling the tilt mechanism may be accommodated.

The first support (seat support) 11 may comprise two L-shaped profiles laterally spaced apart, wherein one leg of each of the L-shaped profiles may be coupled to the chair seat 103 and the other leg of each of the L-shaped profiles is indirectly mounted to the base 10 and displaceable with respect to the base 10. However, although not shown in the figures, the first support 11 may comprise a single element, for example, the first support may comprise a U shaped profile with a central section coupled to the chair seat 103 and side walls extending downwards and mounted indirectly to the base 10 like the legs of the L-shaped profiles. The side walls may be connected to the base 10 such that they are displaceable with respect to the base 10.

Figure 10:
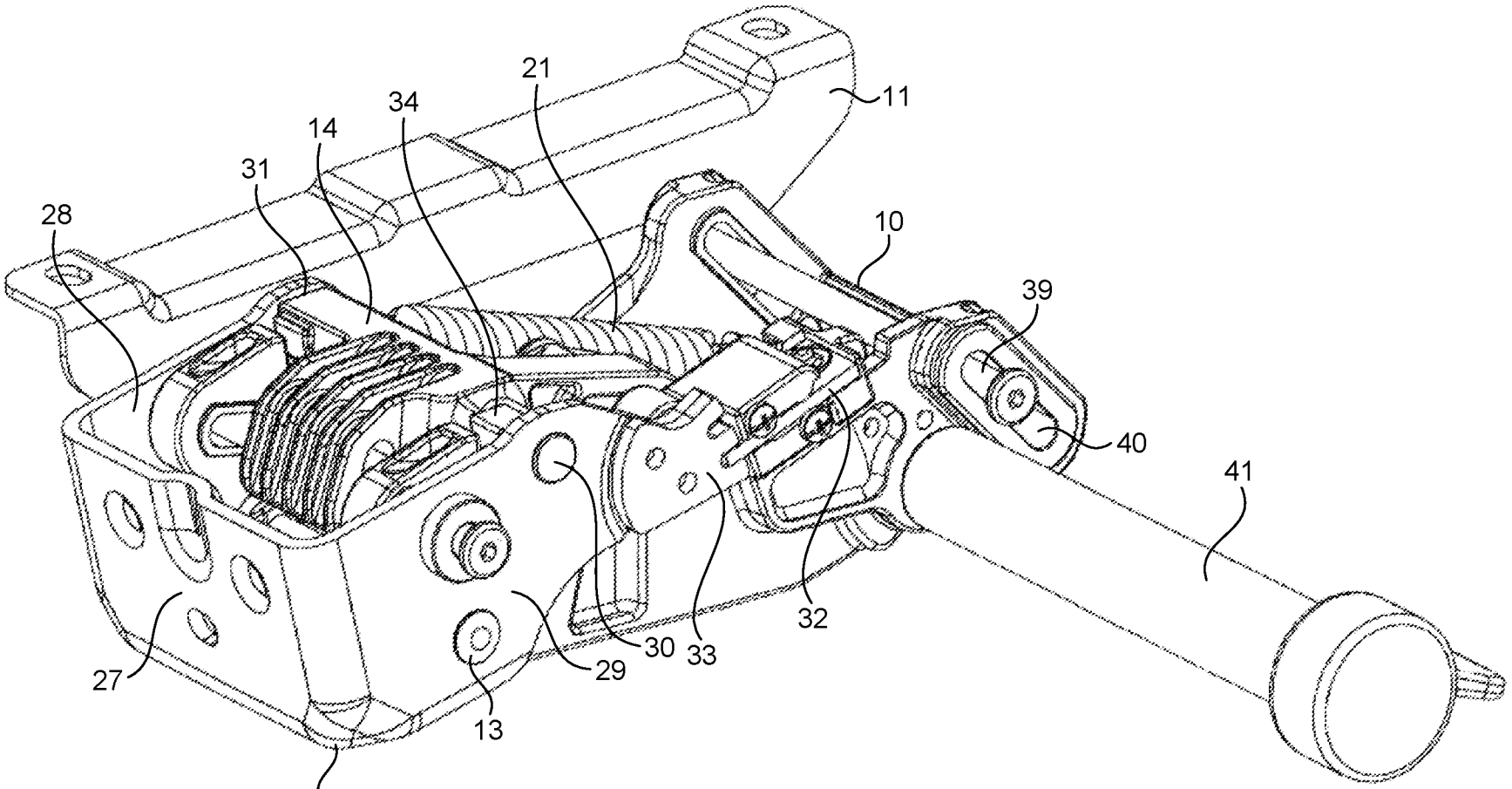
FIG. 10 is a schematic partial perspective view of the chair tilt mechanism of FIG. 2 in a partially tilted position.

The second support (back support) 12 may have a U-shaped cross section forming a central section 27, a first arm 28 and a second arm 29 (see for example FIG. 10). The central section 27 may be coupled to the chair back 104. The first and second arms 28, 29 may be coupled pivotably to the side walls of the base 10 about the first pivot axis 13, for example via a pin extending along the first pivot axis 13 or via corresponding pivot bearings at each side wall of the base 10.

The link element 14 is accommodated between the sidewalls of the base 10. The link element 14 is pivotably coupled to the second support 12 about the second pivot axis 15, for example via a pin extending from the first arm 28 to the second arm 29 through a matching opening in the link element 14. The first pivot axis 13 and the second pivot axis 15 are arranged in parallel and spaced apart from each other. Thus, the link element 14 is at least partially positively driven by a movement or rotation of the second support 12 when the chair back 104 is tilted.

The first guide slot 17 is provided at each of the sidewalls of the base 10. In the sectional side view shown in FIG. 3, a side view of one of the sidewalls of the base 10 is shown with the corresponding first guide slot 17. The first guide slot 17 may comprise a linear guide slot. In the link element 14 a second guide slot 18 is provided. The second guide slot 18 may also comprise a linear guide slot. A shaft 16 is attached to the first support 11 and extends through the first guide slot 17 of one side wall of the base 10, next through the second guide slot 18 of the link element 14 and further through the first guide slot 17 of the other side wall of the base 10. Both ends of the shaft 16 may be mounted at the first support 11. As indicated in FIG. 3, a longitudinal direction of the first guide slot 17 and a longitudinal direction of the second guide slot 18 are not parallel, but arranged angular, such that a positively driven arrangement of the first guide slot 17, the second guide slot 18 and the shaft 16 may be achieved. As the shaft 16 is mounted at the rearward end of the first support 11, the rearward end of the first support 11 is also positively driven by the arrangement of the link element 14, the base 10 and the shaft 16. As the link element 14 is coupled to the second support 12 and driven by tilting the second support 12, a coordinated movement between the tilting of the second support 12 and a movement of the first support 11 can be achieved. At the forward end of the first support 11, a further shaft 39 may be provided extending in parallel to the shaft 16. Furthermore, a third guide slot 40 may be provided at each of the sidewalls of the base 10 in a front area of the base 10 such that the further shaft 39 is extending through the third guide slots 40 and positively drives the front end of the first support 11. The first guide slot 17 and the third guide slot 40 may have a different angle of inclination with respect to the bottom wall of the base 10. Therefore, when the first support 11 is moved driven by shaft 16 in the front-and rear direction, a change of the height of the front side of the first support 11 is different compared to a change of the height of the rear side of the first support 11. Thus, the first support 11 and consequently the chair seat 103 may not only be moved in the front-rear direction, but also tilted when the chair back 104 is tilted.

At the base 10, a further shaft 19 may be provided which extends in parallel to the shaft 16. A fourth guide slot 20 may be provided in the link element 14 through which the further shaft 19 is extending. The further shaft 19 in combination with the fourth guide slot 20 provides a coordinated movement of the link element 14, when the link element 14 is driven via the second pivot axis 15 when the second support 12 is tilted.

FIG. 2 shows furthermore a handle 41 which may be operated by an occupant and which may actuate a locking mechanism of the tilt mechanism 100. The locking mechanism locks and unlocks the coordinated movement of the first support 11 and the second support 12. In a locked state of the locking mechanism, the first support 11 and the second support 12 are maintained in a fixed position with respect to the base 10. In an unlocked state of the locking mechanism, the first support 11 and the second support 12 may be moved in a coordinated manner with respect to the base 10. Details on the locking mechanism will be described in connection with FIGS. 10 to 15.

Figure 4:
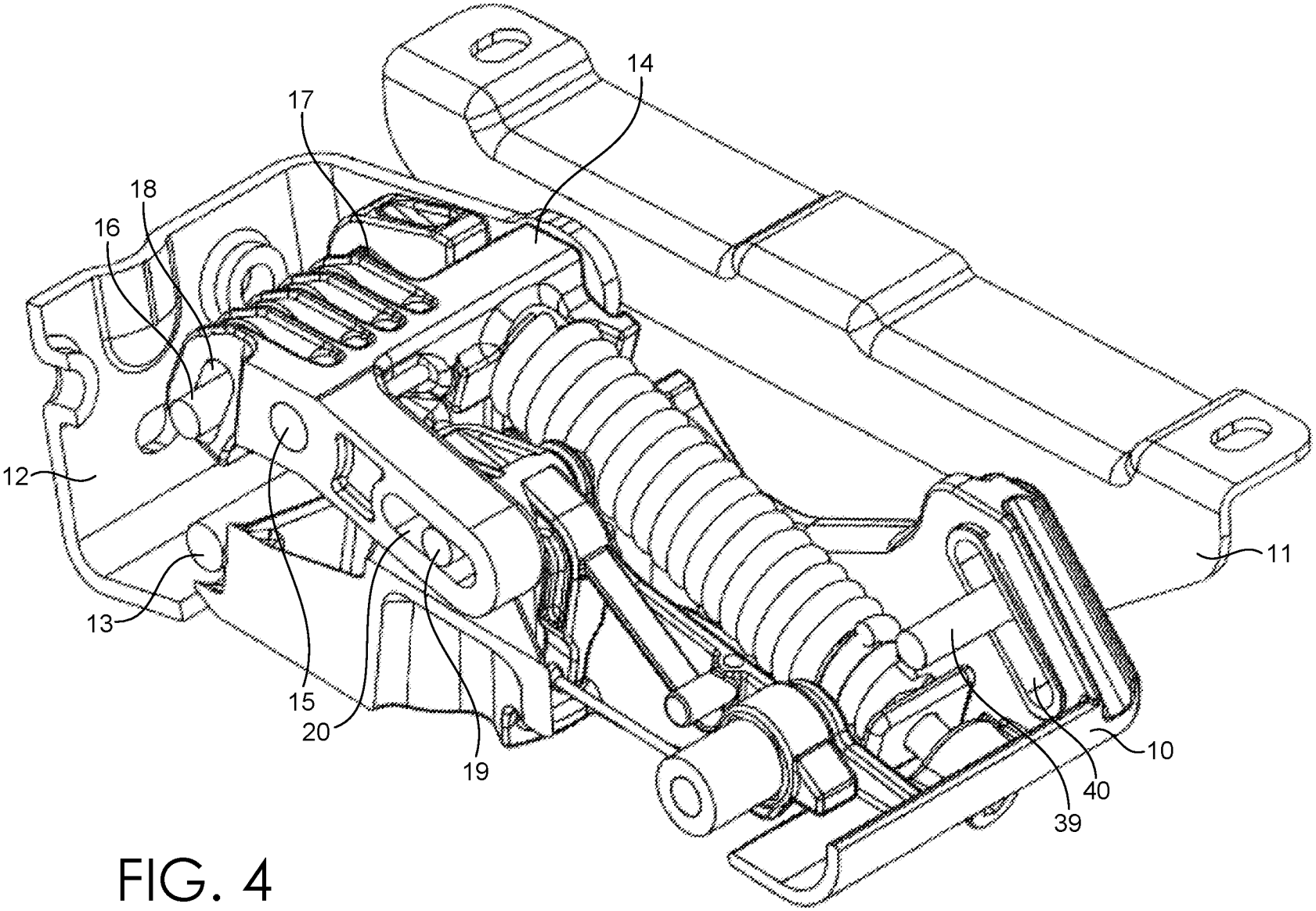
FIG. 4 is a schematic partial perspective view of the chair tilt mechanism of FIG. 2 in a partially tilted position.

FIG. 4 shows a schematic perspective partial sectional view of the tilt mechanism 100. In particular, FIG. 4 shows the arrangement of the link element 14 accommodated between the sidewalls of the base 10 and between the arms of the U-shaped second support 12.

In the following, the coordinated movement between the first support 11 and the second support 12 will be described in more detail. The tilt mechanism 100 may enable to move the chair back 104 between a zero tilt and a full tilt position. In the zero tilt position, the chair back may be arranged in an essentially perpendicular direction with respect to the surface on which the chair 101 is provided.

Consequently, the central section of the U shaped second support 12 may be arranged in the zero tilt position in an essentially perpendicular direction with respect to the surface on which the chair 101 is provided. In the full tilt position, the chair back 101 as well as the central section of the U-shaped second support 12 may be inclined in an angle from about 30° to about 50° from the zero tilt position. The full tilt position as well as the zero tilt position may be limited by the tilt mechanism 100. In the following, a position between the full tilt position and the zero tilt position will be called partially tilt position.

Figure 5:
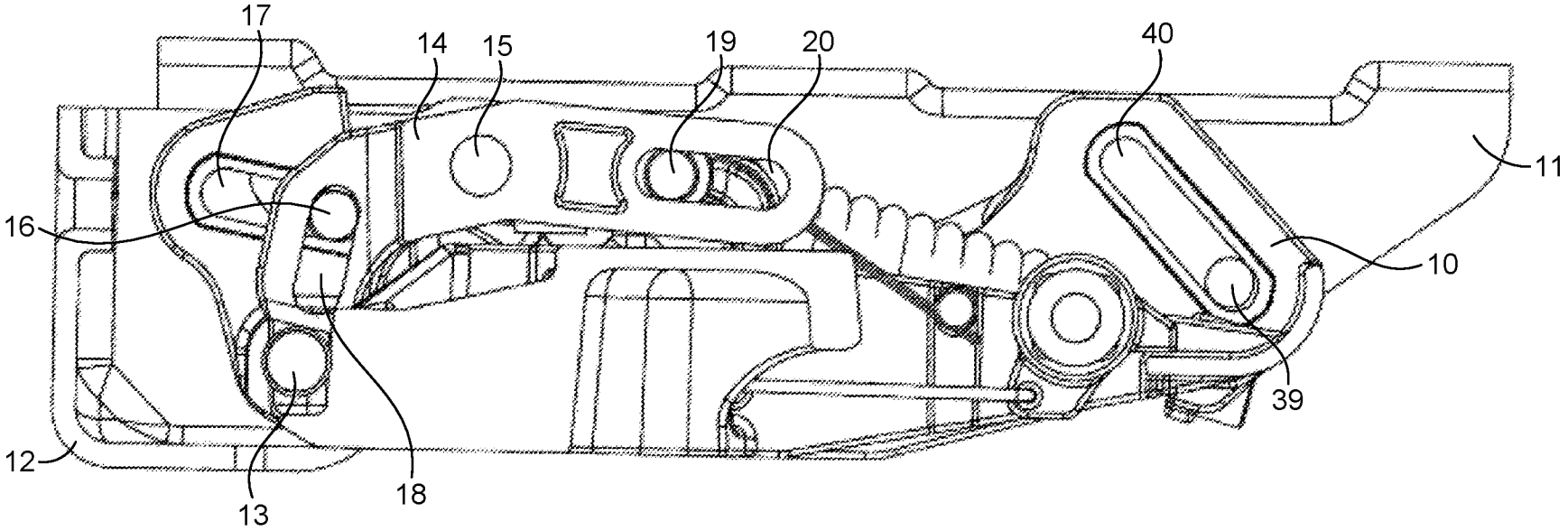
FIG. 5 is a schematic cross-sectional side view of the chair tilt mechanism of FIG. 2 in a zero tilt position.

FIG. 5 shows a sectional side view of the tilt mechanism 100 in the zero tilt position. The shaft 39 is located at the lowest and furthest forward position in the third guide slot 40. The shaft 16 is arranged at the uppermost position of the second guide slot 18 and at the furthest forward position of the first guide slot 17. The shaft 19 is arranged at the rearmost position of the fourth guide slot 20.

Figure 6:
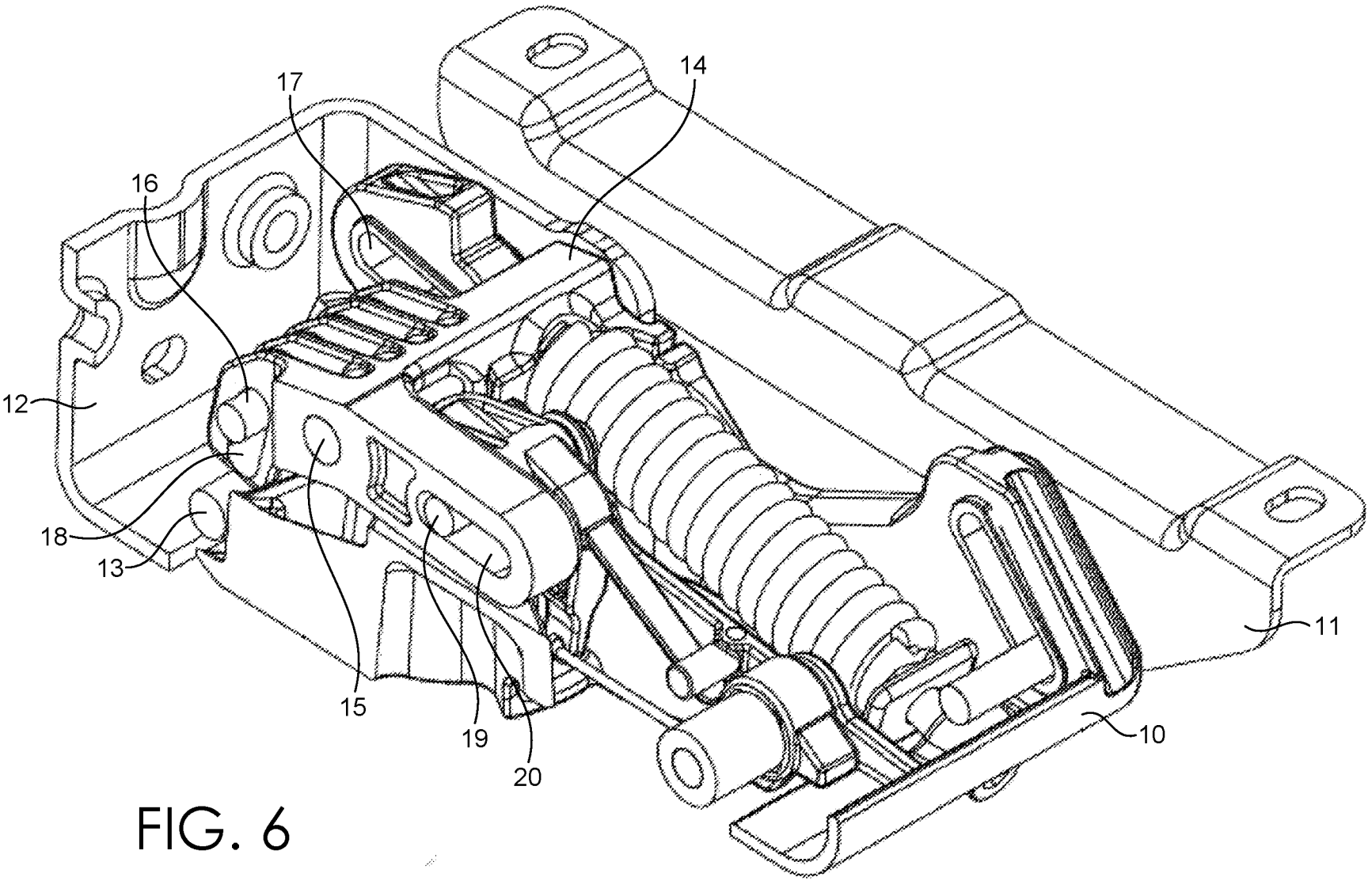
FIG. 6 is a schematic partial perspective view of the chair tilt mechanism of FIG. 2 in a zero tilt position.

FIG. 6 shows a perspective sectional view of the tilt mechanism 100 in this zero tilt position.

Figure 7:
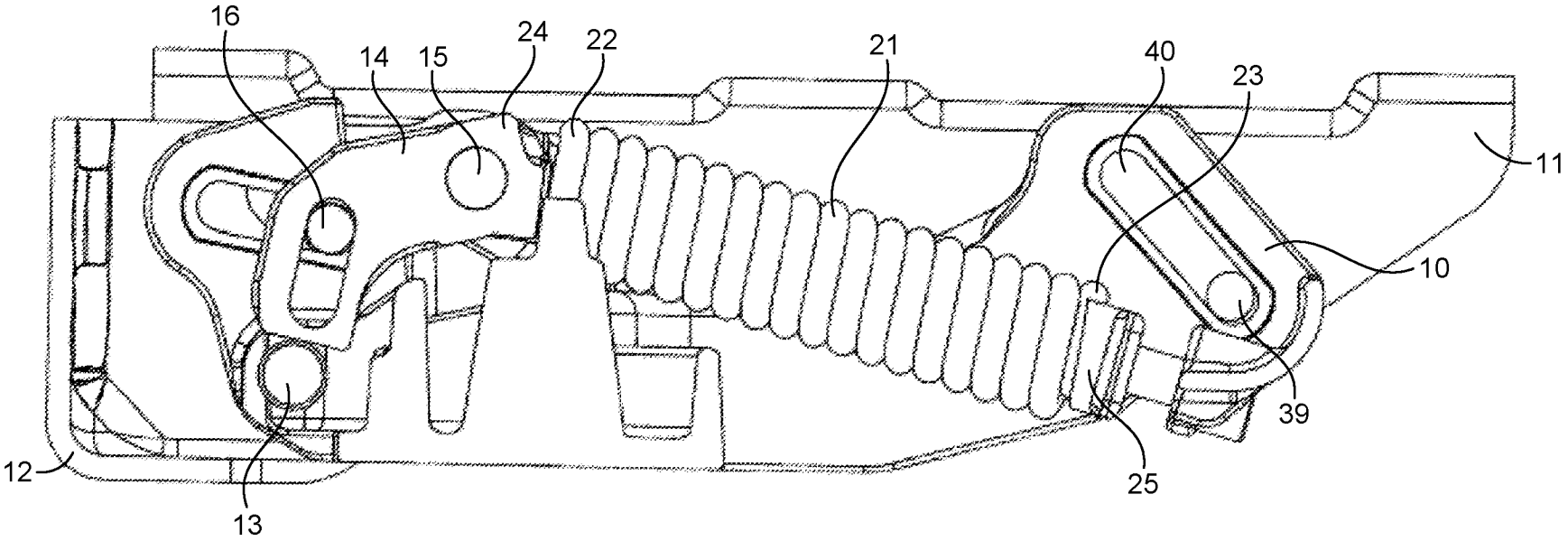
FIG. 7 is a further schematic cross-sectional side view of the chair tilt mechanism of FIG. 2 in a zero tilt position.

FIG. 7 shows a further sectional side view of the tilt mechanism 100 in this zero tilt position. In particular, FIG. 7 shows the arrangement of the spring 21 in this zero tilt position. The spring 21 has a first end 22 and a second end 23. The spring 21 may comprise a source of stored energy such that it may provide a restoring force when the distance between the first end 22 and the second end 23 is enlarged. The first end 22 is coupled to a corresponding first spring attachment structure 24 at the link element 14. The second end 23 of the spring 21 is coupled to a second spring attachment structure 25 at the base 10.

Figure 8:
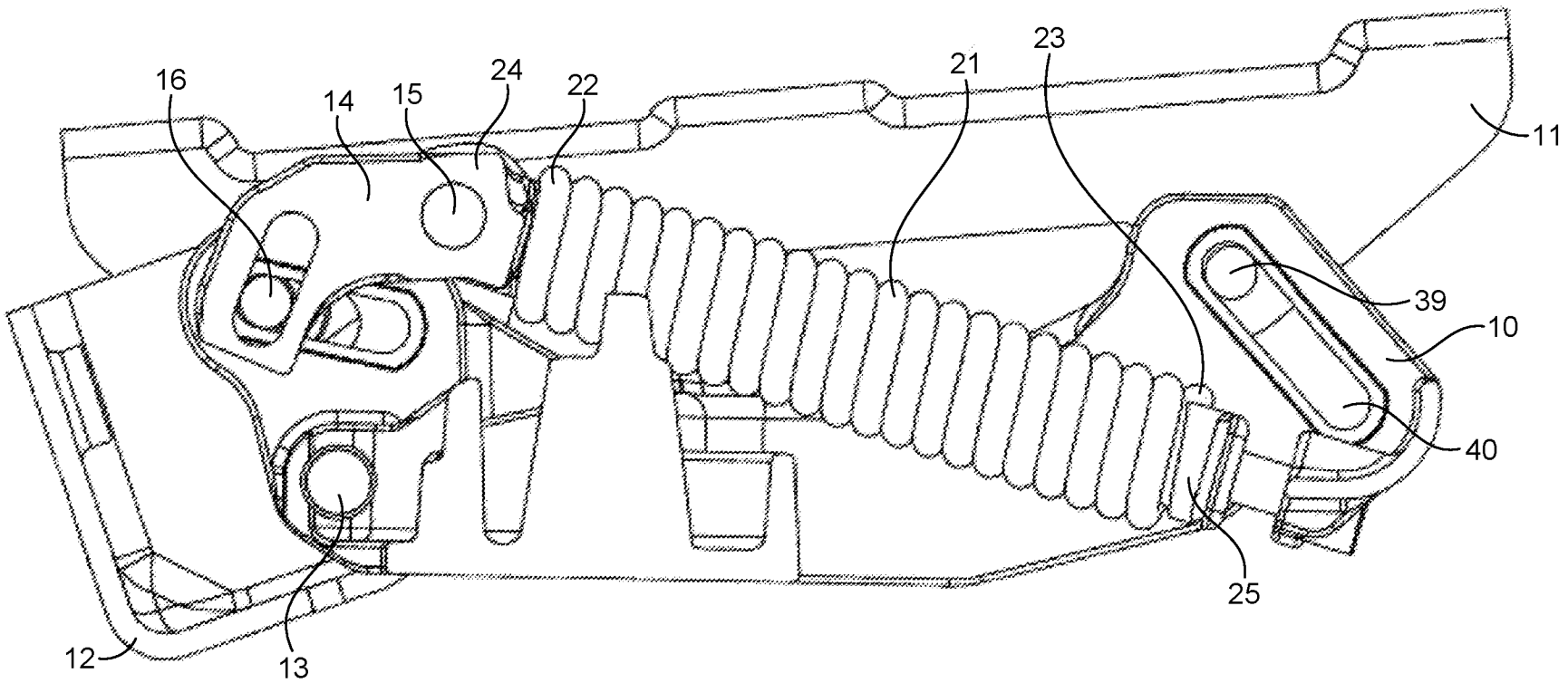
FIG. 8 is a schematic cross-sectional side view of the chair tilt mechanism of FIG. 2 in a full tilted position.

FIG. 8 shows the sectional side view of the tilt mechanism 100 of FIG. 7 in the full tilt position. The second support 12 is inclined into a backward direction by rotating about the first pivot axis 13 with respect to the base 10. Due to the rotating movement of the second support 12, the second pivot axis 15 is moved in a backward direction. Together with the pivot axis 15, the link element 14 is also moved in a backward direction urging the shaft 16 backwards. As the shaft 16 is coupled to the first support 11, the first support 11 is also moved backwards. Further, as the shaft 16 is also guided by the first guide slot 17 in the base 10, the shaft 16 is moved together with the rear part of the first support 11 in an upward direction. The shaft 39 is moved together with the first support 11 in a rearward and upward direction guided in the third guide slot 40. Thus, the first support 11 is moved as a whole together with the chair seat 103 in an upward and rearward direction and is tilted at the same time.

The chair back 104 and thus the second support 12 may be inclined from the zero tilt position in the full tilt position or in any partially tilt position between the zero tilt position and the full tilt position by an occupant sitting on the chair seat 103 and leaning back against the chair back 104. When the link element 14 is moved in the rearward direction, the spring 21 is enlarged and tensioned. Thus, the spring 21 provides a restoring force urging the tilt mechanism 100 back in the zero tilt position when the occupant does not apply a back-leaning force to the chair back 104.

Figure 9:
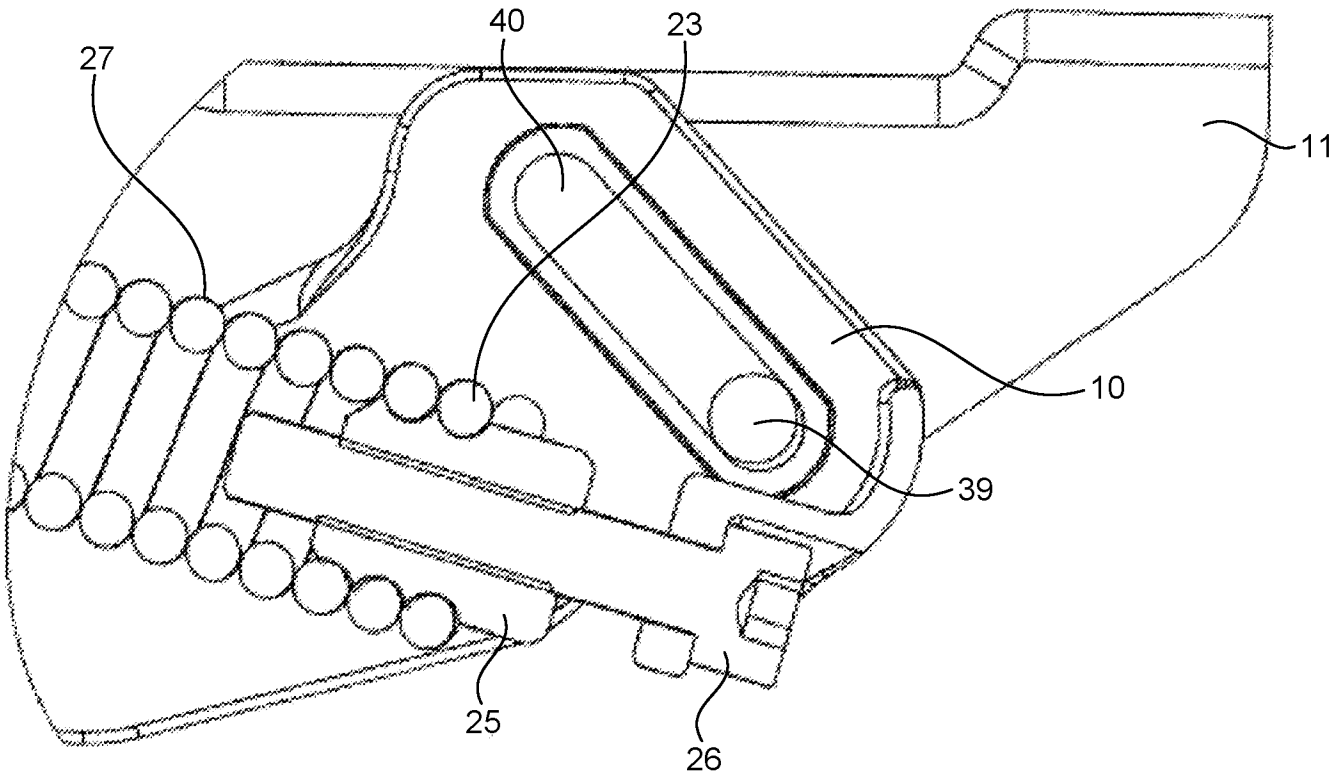
FIG. 9 is a schematic partial cross-sectional side view of the chair tilt mechanism of FIG. 2 showing an adjustment mechanism in more detail.

FIG. 9 shows the second spring attachment structure 25 at the base 10 in more detail. The second spring attachment structure 25 may comprise an adjustment element 26, for example a screw, for adjusting a pre-tension of the spring 21. Thus, the restoring force of the spring 21 may be adjusted.

The tilt mechanism 100 may comprise a locking mechanism for mechanically locking the tilt mechanism in certain positions, for example in the full tilt position, in the zero tilt position and in at least some partially tilted positions. As shown in FIGS. 10 to 15, the locking mechanism may comprise a male lock plate 32, a female engage plate 33, a spring element 37, and a coupling element 38. The female engage plate 33 is mounted at the second support 12. Thus, the female engage plate 33 is moving together with the second support 12. The female engage plate 33 comprises a plurality of recesses into which the male lock plate 32 may engage. The male lock plate 32 is arranged in a guidance which is mounted at the base 10. The male lock plate 32 can slide in the forward and backward direction between a front position and a rear position. In the front position, the male lock plate 32 is disengaged from the female engage plate 33 such that the second support 12 can be freely moved and rotated around the first pivot axis 13. In the rear position, the male lock plate 32 is engaged with one of the recesses at the female engage plate 33. Therefore, in the rear position of the male lock plate 32, the second support 12 cannot rotate about the first pivot axis 13. Thus, in the front position of the male lock plate 32, the tilt mechanism 100 is in the unlocked state and can be freely adjusted, whereas in the rear position of the male lock plate 32, the tilt mechanism 100 is in the locked state and the second support 12 is locked in a certain position.

Figure 12:
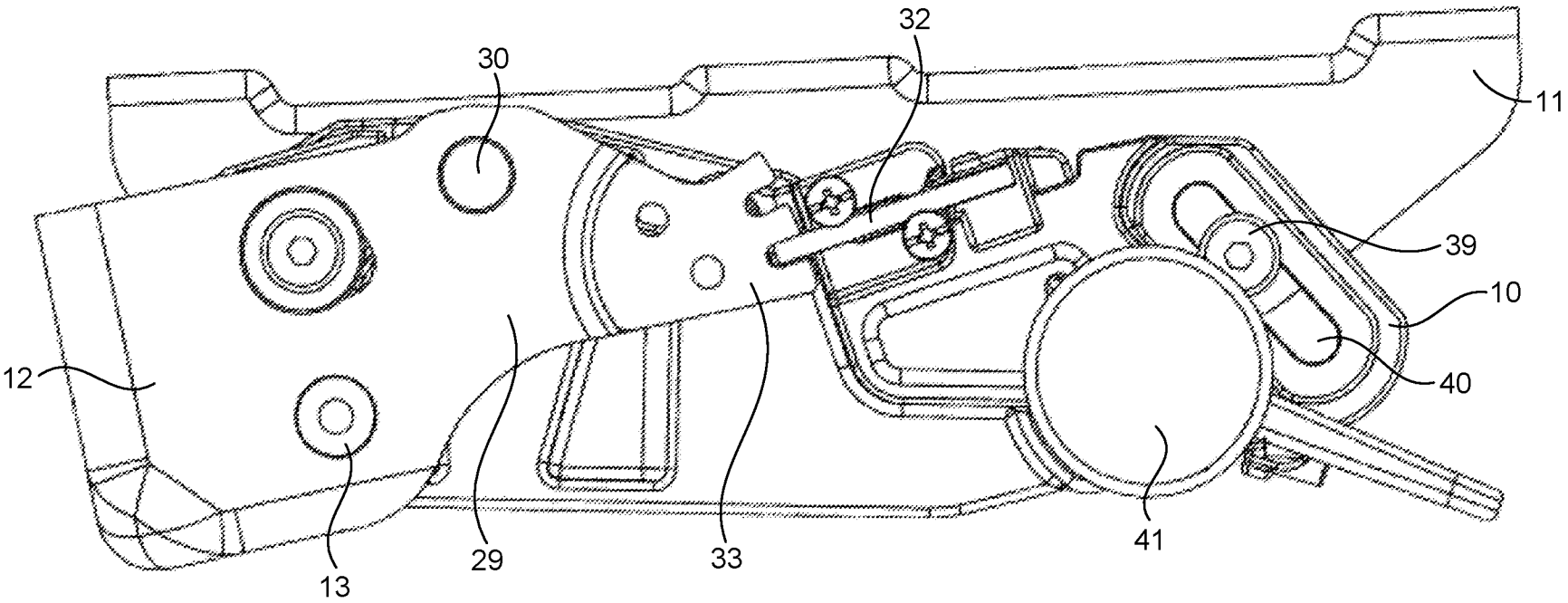
FIG. 12 is a further schematic cross-sectional side view of the chair tilt mechanism of FIG. 2 showing a locking mechanism in more detail.

FIGS. 10 and 12 show the locked state of the tilt mechanism 100 in a partially tilted position in a perspective view and the side view, respectively.

Figure 11:
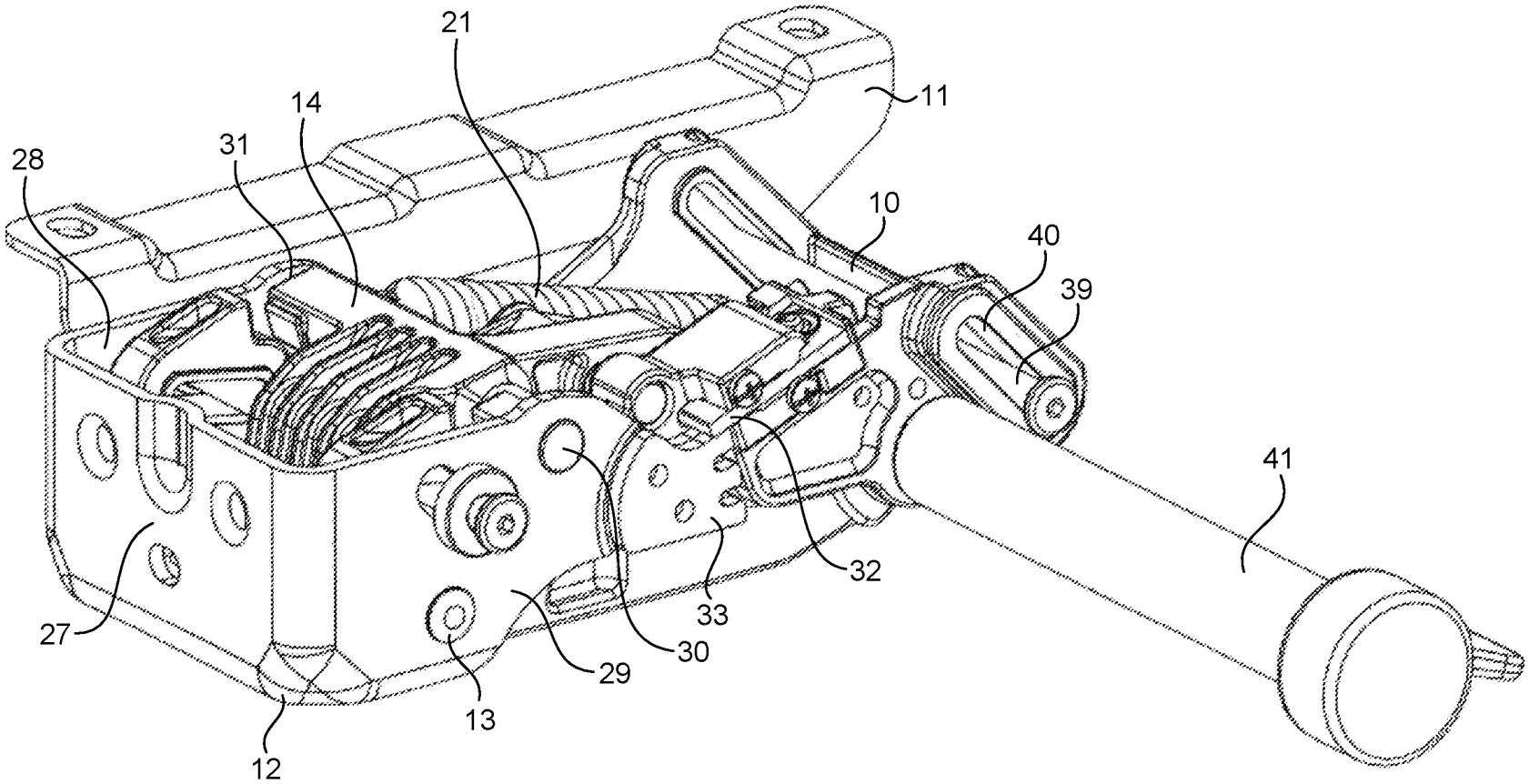
FIG. 11 is a further schematic partial perspective view of the chair tilt mechanism of FIG. 2 in a zero tilt position.
Figure 13:
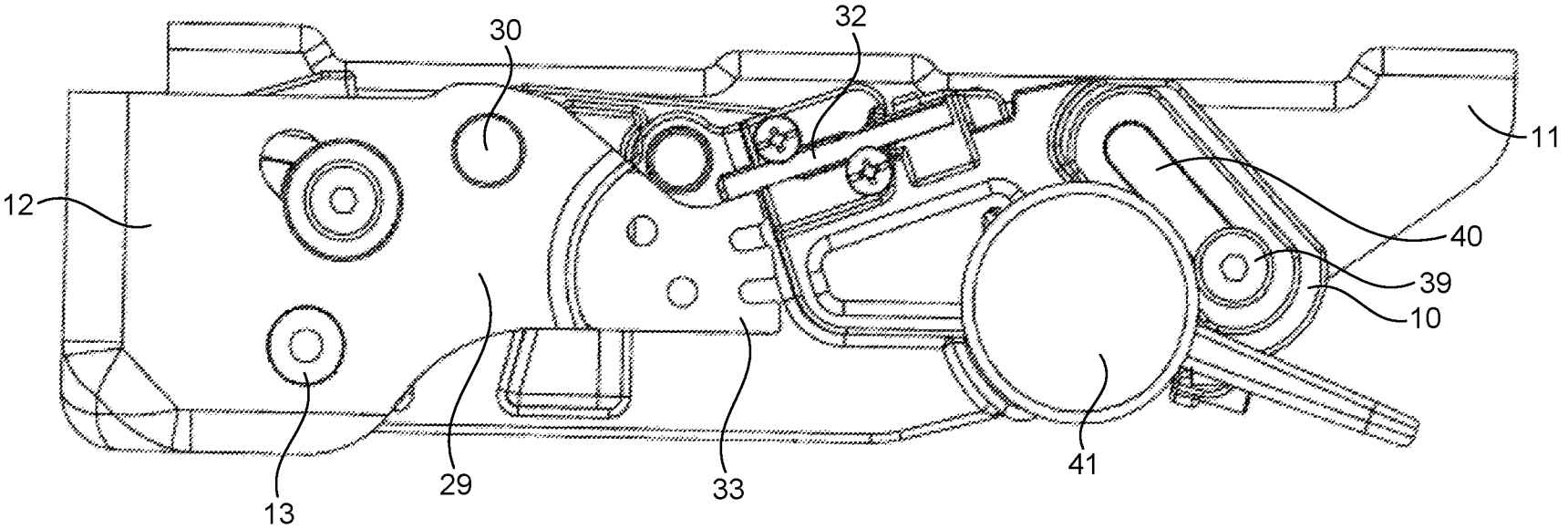
FIG. 13 is yet a further schematic cross-sectional side view of the chair tilt mechanism of FIG. 2 showing the locking mechanism in more detail.

FIGS. 11 and 13 show the locked state of the tilt mechanism 100 in the zero tilt position in a perspective view and a side view, respectively.

The male lock plate 32 may be operated by the occupant with the handle 41. The handle 41 may be rotated around its longitudinal direction. For example, the handle 41 may be rotated in a clockwise direction for unlocking the tilt mechanism 100, and the handle 41 may be rotated in a counter-clockwise direction for locking the tilt mechanism 100.

Figure 14:
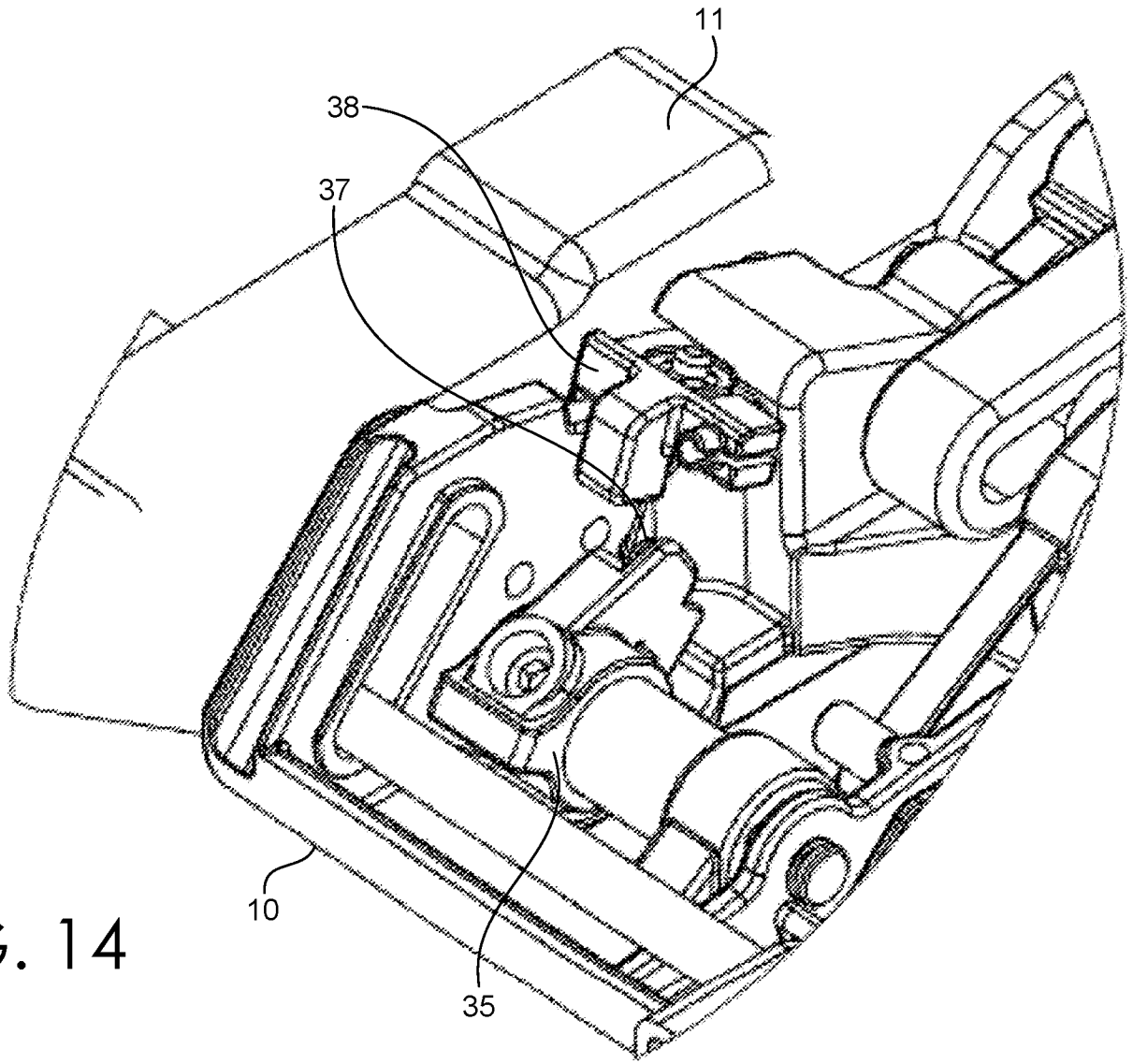
FIG. 14 is a schematic partial perspective view of the chair tilt mechanism of FIG. 2 showing the locking mechanism in more detail.
Figure 15:
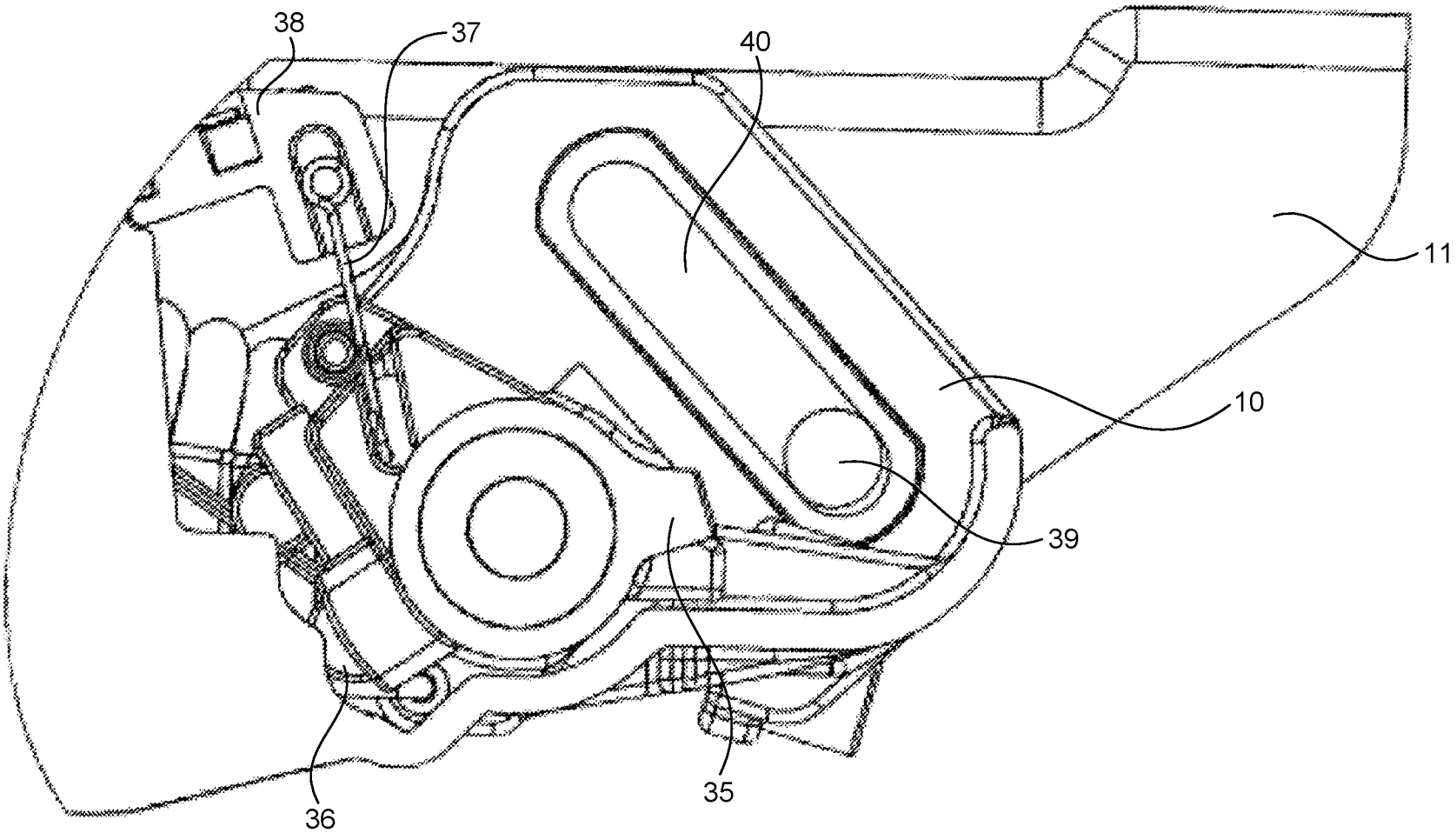
FIG. 15 is a further schematic cross-sectional side view of the chair tilt mechanism of FIG. 2 showing some more details of the locking mechanism.

FIGS. 14 and 15 show the elements for controlling the locking mechanism in more detail. The spring element 37 may be coupled to the handle 41 at a proximal end of the spring element 37 via a control element 35. The distal end of the spring element 37 may be engaged with the coupling element 38, which is coupled with the male lock plate 32.

When the handle 41 is rotated in the clockwise direction, the distal end of the spring element 37 urges the coupling element 38 together with the male lock plate 32 in the forward direction, thus unlocking the tilt mechanism 100.

When the handle 41 is rotated in the counter-clockwise direction, the distal end of the spring element 37 urges the coupling element 38 together with the male lock plate 32 in the rearward direction. When the male lock plate 32 is facing one of the recesses of the female engage plate 33, the spring element 37 moves the male lock plate 32 into this recess of the female engage plate 33. However, when the male lock plate 32 does not face one of the recesses of the female engage plate 33, the spring element urges the male lock plate 32 against one of the teeth between the recesses of the female engage plate 33. The second support 12 is still moveable. However, when the second support 12 is moved, the male lock plate 32 will engage with one of the recesses of the female engage plate 33 as soon as possible, thus locking the tilt mechanism 100.

As further shown in figure FIG. 15, a detent element 36 may be provided at the handle 41 or the control element 35 for locking the handle 41 in the locking and unlocking position.

In particular FIGS. 10 and 11 show the arrangement of the locking mechanism in parallel to the spring 21 at the second support 12 and the link element 14, respectively. The second pivot axis 15 has a first end 31 and a second end 30. The spring 21 is mounted at the link element 14 near the first end 31, whereas the locking mechanism is arranged at the opposite side near the second and 30. This allows a compact design of the tilt mechanism 100.

While the tilt mechanism 100 has been described with linear guide slots 17, 18, 20 and 40, these guide slots may be formed as arced guide slots. Furthermore, at least some of the guide slots 17, 18, 20 and 40 may also be formed as blind slots.

Furthermore, the tilt mechanism 100 may comprise further components, for example two or more springs instead of the single spring 21, and a handle and a mechanism for the gas cylinder 108.

While exemplary embodiments have been described in the context of office-type chairs, the tilt mechanism 100 and the chair 101 according to embodiments of the invention are not limited to this particular application. Rather, embodiments of the invention may be employed to effect a coordinated motion of a chair back and the chair seat in a wide variety of chairs.

The invention claimed is:

1. A tilt mechanism for a chair, configured to affect a coordinated movement of a chair seat and chair back, the tilt mechanism comprising:

a base, a first support configured to support the chair seat and mounted to the base, a second support configured to support the chair back and pivotably coupled to the base about a first pivot axis, a link element pivotably coupled to the second support about a second pivot axis, and a shaft having a first end and a second end, the first end of the shaft and the second end of the shaft are both coupled to the first support, wherein a first guide slot is provided at the base and a second guide slot is provided at the link element, wherein the shaft is supported in the first guide slot and the second guide slot such that pivoting the second support relative to the base causes the shaft to be displaced along the first and second guide slots.

2. The tilt mechanism according to claim 1, wherein a longitudinal direction of the shaft is parallel to the first pivot axis.

3. The tilt mechanism according to claim 1, wherein the second pivot axis is different from the first pivot axis.

4. The tilt mechanism according to claim 1, wherein the first pivot axis is parallel to the second pivot axis.

5. The tilt mechanism according to claim 1, wherein the first guide slot comprises a first linear guide slot and the second guide slot comprises a second linear guide slot.

6. The tilt mechanism according to claim 5, wherein the first linear guide slot and the second linear guide slot are arranged nonparallel such that, when the shaft is displaced along the first and second linear guide slots, an angle between a direction of the first linear guide slot and a direction of the second linear guide slot varies.

7. The tilt mechanism according to claim 1, further comprising an energy storage mechanism including a first end and a second end, the first end being coupled to a first attachment structure provided at the link element and the second end being coupled to a second attachment structure provided at the base, wherein an energy level stored in the energy storage mechanism depends on a distance between the first end and the second end.

8. The tilt mechanism according to claim 7, wherein the tilt mechanism is configured such that a distance between the first attachment structure and the second attachment structure varies upon pivoting the second support relative to the base.

9. The tilt mechanism according to claim 7, wherein the first attachment structure is provided at the second pivot axis.

10. The tilt mechanism according to claim 7, wherein the energy storage mechanism comprises a single tension spring.

11. The tilt mechanism according to claim 7, wherein the second support comprises a U-shaped section forming a central section, a first arm and a second arm, wherein a pin extends along the second pivot axis from the first arm to the second arm through an opening in the link element, wherein the pin includes a first end and a second end in #s a longitudinal direction of the pin, wherein the first attachment structure is arranged closer to the first end of the pin than to the second end of the pin.

12. The tilt mechanism according to claim 11, comprising a locking mechanism mounted at the base and configured to engage with a locking section provided at the link element for inhibiting a movement of the link element upon actuating the locking mechanism.

13. The tilt mechanism according to claim 12, wherein the locking section is arranged closer to the second end of the pin than to the first end of the pin.

14. The tilt mechanism according to claim 1, further comprising a second shaft attached to the first support and supported in a third guide slot provided at the base.

15. The tilt mechanism according to claim 14, wherein a longitudinal direction of the second shaft is parallel to a longitudinal direction of the shaft.

16. A chair, comprising a chair base assembly; a chair seat; a chair back; and a tilt mechanism configured to affect a coordinated movement of the chair seat and the chair back, the tilt mechanism comprising:

a base attached to the chair base assembly, a first support attached to the chair seat and mounted to the base, the first support being configured to support the chair seat, a second support attached to the chair back and pivotably coupled to the base about a first pivot axis, the second support being configured to support the chair back, a link element pivotably coupled to the second support about a second pivot axis, and a shaft having a first end and a second end, the first end of the shaft and the second end of the shaft are both coupled to the first support, wherein a first guide slot is provided at the base and a second guide slot is provided at the link element, wherein the shaft is supported in the first guide slot and the second guide slot such that pivoting the second support relative to the base causes the shaft to be displaced along the first and second guide slots.

* * * * *